US011597204B2

(12) United States Patent
Chen et al.

(10) Patent No.: US 11,597,204 B2
(45) Date of Patent: Mar. 7, 2023

(54) FLUID EJECTION POLYMERIC RECIRCULATION CHANNEL

(71) Applicant: Hewlett-Packard Development Company, L.P., Spring, TX (US)

(72) Inventors: Chien-Hua Chen, Corvallis, OR (US); Michael W. Cumbie, Corvallis, OR (US); Si-Iam J. Choy, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/297,718

(22) PCT Filed: Jun. 25, 2019

(86) PCT No.: PCT/US2019/039077

§ 371 (c)(1),
(2) Date: May 27, 2021

(87) PCT Pub. No.: WO2020/263235

PCT Pub. Date: Dec. 30, 2020

(65) Prior Publication Data

US 2022/0105725 A1 Apr. 7, 2022

(51) Int. Cl.
*B41J 2/14* (2006.01)
*B41J 2/16* (2006.01)

(52) U.S. Cl.
CPC ..... *B41J 2/14145* (2013.01); *B41J 2/14201* (2013.01); *B41J 2/1601* (2013.01); *B41J 2/1607* (2013.01); *B41J 2/1637* (2013.01)

(58) Field of Classification Search
CPC .. B41J 2/14145; B41J 2/14201; B41J 2/1601; B41J 2/1607; B41J 2/1637; B41J 2/1603; B41J 2/1623; B41J 2002/14459; B41J 2202/12; B41J 2/18
See application file for complete search history.

(56) References Cited

U.S. PATENT DOCUMENTS

| | | | | |
|---|---|---|---|---|
| 9,523,011 | B2 | 12/2016 | Robello et al. | |
| 9,605,168 | B2 | 3/2017 | Pervan | |
| 2009/0096838 | A1 | 4/2009 | Chino et al. | |
| 2010/0271445 | A1* | 10/2010 | Sharan | B41J 2/1632 156/257 |

(Continued)

FOREIGN PATENT DOCUMENTS

| | | |
|---|---|---|
| CN | 203792900 | 8/2014 |
| TW | 201304971 A | 2/2013 |
| TW | 201910143 A | 3/2019 |

OTHER PUBLICATIONS

IP.com search (Year: 2022).*

*Primary Examiner* — Lisa Solomon
(74) *Attorney, Agent, or Firm* — Foley & Lardner LLP

(57) ABSTRACT

A fluid ejection assembly may include a fluid ejection die comprising a back face and a front face through which fluid is ejected. The fluid ejection die may further include a fan-out fluid passages converging towards the back face of the fluid ejection die, the fan-out fluid passages comprising a first fan-out fluid passage and a second fan-out fluid passage and a recirculation channel extending within a polymeric material from the first fan-out fluid passage to the second fan-out fluid passage adjacent the back face of the fluid ejection die.

15 Claims, 5 Drawing Sheets

(56) References Cited

U.S. PATENT DOCUMENTS

| | | | |
|---|---|---|---|
| 2013/0229473 | A1 | 9/2013 | Wells et al. |
| 2015/0085018 | A1 | 3/2015 | Yamada et al. |
| 2018/0030292 | A1 | 2/2018 | Gotou et al. |

* cited by examiner

FLUID EJECTION POLYMERIC RECIRCULATION CHANNEL

BACKGROUND

Fluid ejection devices selectively ejected droplets of fluid. The fluid may sometimes contain pigments or other particles that may tend to settle. Such settled particles may detrimentally impact the performance of the fluid ejection devices.

Figure 1:
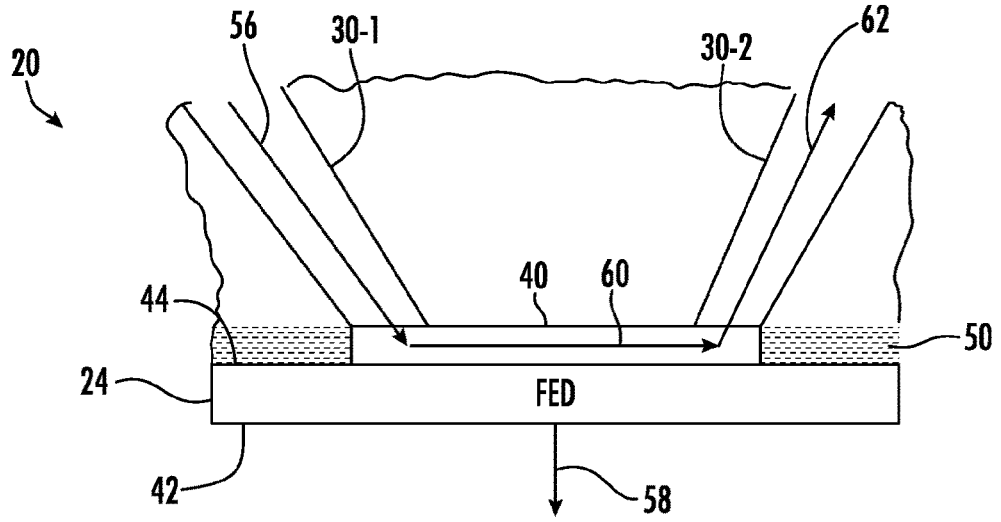
FIG. 1 is a sectional view schematically illustrating portions of an example fluid ejection assembly.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example fluid ejection assemblies, fluid ejection assembly components and methods that facilitate recirculation of the fluid to agitate or mix the fluid and reduce settling. The disclosed fluid ejection assemblies, fluid ejection assembly components and methods supply fluid to a fluid ejection die through fan-out fluid passages that converge towards a back face of a smaller dimensioned fluid ejection die. A recirculation passage connects different fan-out fluid passages to recirculate the fluid across a back face of the die. The recirculation passage is formed within a polymeric material. The formation of the recirculation passage in the polymeric material provides for a lower cost recirculation passage and a lower cost fluid ejection assembly. The use of the polymeric material further facilitates a dense arrangement of multiple recirculation passages having reduced pitch while not sacrificing channel depth. In addition to providing a low-cost recirculation passage, the polymeric material in which the recirculation passages formed provides more uniform heat distribution and greater chemical resistance to various fluids as compared to silicon.

In some implementations, a fluid ejection assembly is formed from a fluid ejection die and a single unitary polymeric body. For purposes of this disclosure, a "single unitary polymeric body" refers to a single integral unitary body formed from a single mass of polymeric material, lacking distinct structures that are bonded, welded, fastened or otherwise joined together. The single mass polymeric material may be homogenous or may have different material compositions or mixtures in different portions of the single mass of material.

The single unitary polymeric body is joined to the back face of the fluid ejection die. The single unitary polymeric body includes both the fan-out fluid passages as well as the recirculation passage. In one implementation, the single unitary body comprises a molded polymer in which the fan-out fluid passages and the recirculation passage are molded. In some implementations, the single unitary body comprises a multitude of recirculation passages.

In some implementations, a fluid ejection assembly is formed from a fluid ejection die, a first unitary polymeric body in which the fan-out fluid passages are formed and a second unitary polymeric body sandwiched between and joined to the fluid ejection die in the first unitary polymeric body. The second or intermediate unitary polymeric body provides the recirculation passage or the series of recirculation passages. Examples of polymeric material in which the recirculation passage or passages may be formed include, but are not limited to, epoxy mold compound, or thermoplastic such as polyphenylene sulfide (PPS), polyethylene (PE), polyethylene terephthalate (PET), polyether ether ketone (PEEK), polysulfone (PSU), liquid crystal polymer (LCP), and the like.

Disclosed is an example fluid ejection assembly that may include a fluid ejection die comprising a back face and a front face through which fluid is ejected. The fluid ejection die may further include a fan-out fluid passages converging towards the back face of the fluid ejection die, the fan-out fluid passages comprising a first fan-out fluid passage and a second fan-out fluid passage and a recirculation channel extending within a polymeric material from the first fan-out fluid passage to the second fan-out fluid passage adjacent the back face of the fluid ejection die.

Disclosed is an example fluid ejection assembly component for forming part of a fluid ejection assembly. The component may comprise a unitary polymeric body that comprises converging fan-out fluid passages and recirculation channels. The fan-out fluid passages comprising a first fan-out fluid passage and a second fan-out fluid passage. The recirculation channels extend from the first fan-out fluid passage to the second fan-out fluid passage.

Disclosed is an example method for forming a fluid ejection assembly. The method may comprise providing a fluid ejection die, molding a unitary polymeric body and joining the molded unitary polymeric body adjacent a back face of the fluid ejection die. The polymeric body that is molded may include fan-out fluid passages that converge and a recirculation channel. The fan-out fluid passages comprise a first fan-out fluid passage and a second fan-out fluid passage. The recirculation channel extends within a polymeric material from the first fan-out fluid passage to the second fan-out fluid passage.

FIG. 1 is a sectional view schematically illustrating portions of an example fluid ejection assembly 20. Fluid ejection assembly 20 facilitates recirculation of the fluid to agitate or mix the fluid and reduce settling. Fluid ejection assembly 20 recirculates the fluid through a recirculation passage extending behind a fluid ejection die and formed in a polymeric material. Fluid ejection assembly 20 comprises fluid ejection die 24, fan-out fluid passages 30-1, 30-2 (collectively referred to as passages 30) and recirculation channel 40.

Fluid ejection die (FED) 24 comprises a die having a front or fluid ejection face 42 and a rear or back face 44. Die 24 comprises a body formed from a material such as silicon that houses and supports fluid ejection devices that receive fluid from fan-out fluid passage 30-1. Fluid ejection die 24 may include a series of fluid ejection chambers, each chamber having a fluid ejection orifice or nozzle opening. Each fluid ejection device may further include a fluid actuator that displaces fluid within the fluid ejection chamber through the fluid ejection orifice.

In one implementation, the fluid actuator may comprise a thermal resistor which, upon receiving electrical current, heats to a temperature above the nucleation temperature of the solution so as to vaporize a portion of the adjacent solution or fluid to create a bubble which displaces fluid through the orifice. In other implementations, the fluid actuator may comprise other forms of fluid actuators. In other implementations, the fluid actuator may comprise a fluid actuator in the form of a piezo-membrane based actuator, an electrostatic membrane actuator, mechanical/impact driven membrane actuator, a magnetostrictive drive actuator, an electrochemical actuator, and external laser actuators (that form a bubble through boiling with a laser beam), other such microdevices, or any combination thereof.

Fan-out fluid passages 30 comprise fluid passages that converge towards the back face 44 of fluid ejection die 24. Fan-out fluid passages 30 converge towards one another to direct fluid to the generally much smaller dimensioned fluid ejection die 24. As will be described hereafter, in one implementation, fan-out fluid passages 30 are formed within a body distinct from the body in which recirculation channel 40 extends. In other implementations, fan-out fluid passages 30 are formed within a single unitary polymeric body, the same single unitary polymeric body in which recirculation channel 40 extends.

Recirculation channel 40 comprises a passage that extends from fan-out fluid passage 30-1 to fan-out fluid passage 30-2 adjacent the back face 44 of fluid ejection die 24. For purposes of this disclosure, two structures may be considered as "adjacent" to one another despite the provision of an intervening adhesive or other material applied in a viscous state to join the two structures. Recirculation channel 40 facilitates the circulation of fluid across the back face of fluid ejection die 24, between fan-out fluid passages 30. Although not illustrated, in some implementations, fluid ejection assembly 20 may comprise a multitude of recirculation channels that interconnect passages 30 along the back face 44 of fluid ejection die 24.

Recirculation channel 40 extends within a polymeric material 50 (as schematically indicated by stippling). Because recirculation channel 40 is formed within the polymeric material 50, recirculation channel 40 may be provided with more closely controlled shapes and dimensions at a lower cost. The more closely controlled dimensions may facilitate the formation of a larger number or greater density of smaller individually sized recirculation channels which may provide greater circulation velocity for enhanced agitation or mixing. For example, recirculation channel 40 may be molded into the polymeric material 50.

The polymeric material in which recirculation channel 40 extends may define the interior side walls of recirculation channel 40 and may contact or extend adjacent to fluid ejection die 24. As compared to other materials, such as silicon, the polymeric material may have enhanced chemical resistivity to the fluids being circulated. As a result, interior surfaces of the fluid ejection channel 40 have a greater resistance to corrosion caused by the fluid being circulated. Moreover, as compared to other materials such as silicon, the polymeric material may enhance thermal insulative properties, facilitating a more uniform temperature across fluid ejection die 24 and fluid ejection apparatus 20. The more uniform temperature may enhance fluid ejection performance.

In one implementation, the polymeric material 50 in which fluid recirculation channel is formed comprises a molded polymeric material which is shaped while the polymeric material is in a fluid or viscous state and wherein the fluid or liquid polymer material is subsequently hardened or solidified through evaporation or curing. In one implementation, the polymeric material 50 comprises an epoxy mold compound. In another implementation, the polymeric material 50 may be formed from a polymeric material selected from a group of polymeric material such as thermoplastic such as PPS, PE, PET, PEEK, PSU, LCP, and the like, or combinations thereof.

As shown by FIG. 1, the region of the stippling representing the polymeric material 50 has no solid boundaries. This is meant to indicate that the polymeric material 50 may be part of a unitary polymeric body that provides fluid circulation channel 40 independent of a separate body that may form or provide fan-out fluid passages 30 or that the polymeric material 50 may be part of a larger unitary polymeric body that provides both recirculation channel 40 and fan-out fluid passages 30. Examples of each of these variations are described below.

FIG. 1 further illustrates the circulation of fluid in fluid ejection assembly 20. As indicated by arrow 56, fan-out fluid passage 30-1 comprise a passage through which the fluid to be ejected is supplied to the fluid ejection device of fluid ejection die 24. A portion of the fluid supplied through fan-out fluid passage 30-1 may be further directed through fluid supply passages within fluid ejection die 24 to the fluid ejection chambers. Such fluid supply passages may be in the form of fluid feed holes or slots. Thereafter, the fluid received by the fluid ejection die 24 may be selectively ejected by the fluid ejection device as indicated by arrow 58.

As indicated by arrow 60, a portion of the fluid supplied to fan-out fluid passage 30-1 may be circulated through recirculation channel 40, across the back face 44 of fluid ejection die 24. As indicated by arrow 60, the fluid may be circulated through fan-out fluid passage 30-2 out of the recirculation channel 40 and away from the fluid ejection die 24. Such circulated fluid may flow back to a fluid supplier source from which the fluid was provided. As a result, fluid may be recirculated to promote mixing and agitation of the fluid and reduce settling.

Figure 2:
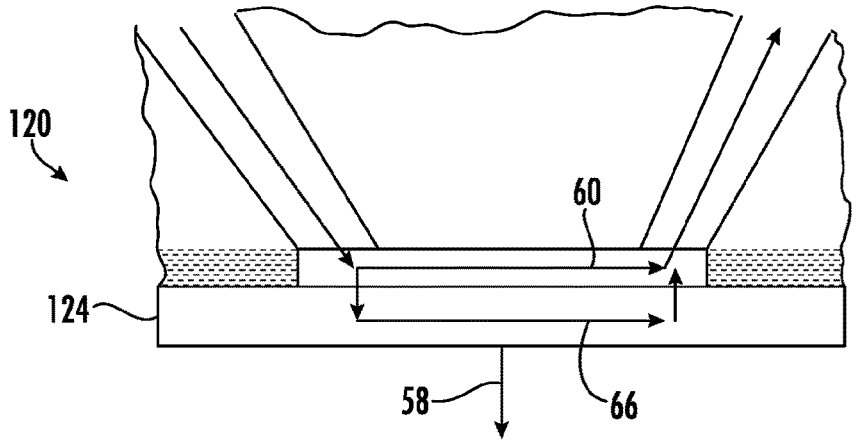
FIG. 2 is a sectional view schematically illustrating portions of an example fluid ejection assembly.

FIG. 2 is a sectional view illustrating portions of an example fluid ejection assembly 120. Fluid ejection assembly 120 is similar to fluid ejection assembly 20 described above except that fluid ejection 120 comprises fluid ejection die 124 in place of fluid ejection die 24. As schematically illustrated by arrow 66, fluid ejection die 124 itself incorporates or provides a die circulation passage that extends across portions of fluid ejection die 124. The die circulation passage represented by arrow 66 may facilitate the circulation of fluid from into and out of one fluid ejection chamber to another fluid ejection chamber. As a result, the die circulation passage represented by arrow 66 and circulation channel 40 provide recirculation routes that extending parallel planes for agitating the fluid and reducing settling of particles out of the fluid.

Figure 3:
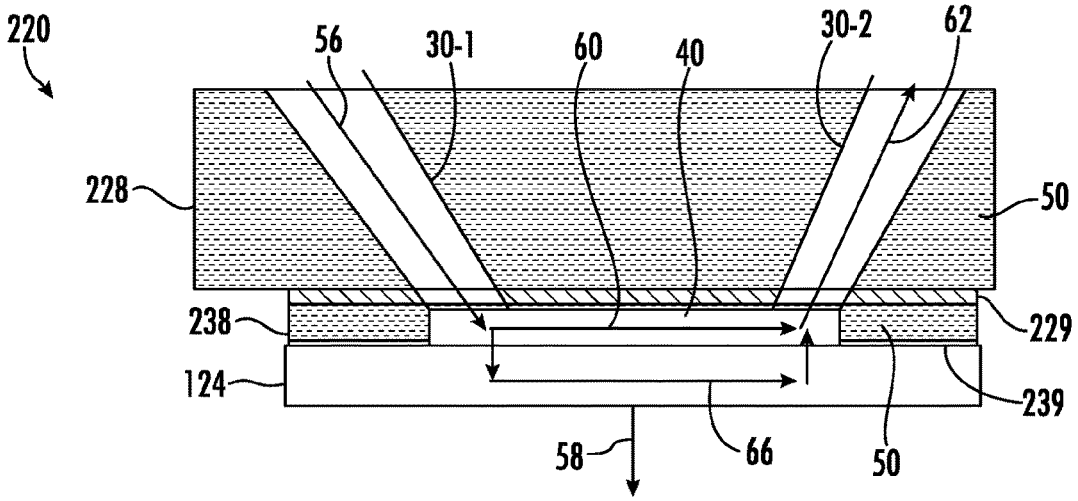
FIG. 3 is a sectional view schematically illustrating portions of an example fluid ejection assembly.

FIG. 3 is a sectional view schematically illustrating portions of an example fluid ejection assembly 220. Fluid ejection assembly 220 is similar to fluid ejection assembly 120 except that fluid ejection assembly 220 specifically comprises a first unitary polymeric body 228 in which fan-out fluid passages 30 are formed and a second unitary polymeric body 238 in which recirculation channel 40 extends or is formed. In the example illustrated, body 228 is joined to body 238 by an intermediate adhesive layer 229. Body 238 is joined to fluid ejection die 124 by an intermediate adhesive layer 239. In other implementations, body 228 may be joined body 238 and body 238 may be joined to fluid ejection die 124 in other ways, such as through the use of fasteners, fusing a welding, connectors and the like. In one implementation, bodies 228 and 238 are formed from the same polymeric material 50. In other implementations, bodies 228 and 238 are formed from different polymeric materials. In some implementations, body 238 is formed from polymeric material 50 while body 228 is formed from a non-polymeric material, such as a ceramic, glass, silicon or other material.

Figure 4:
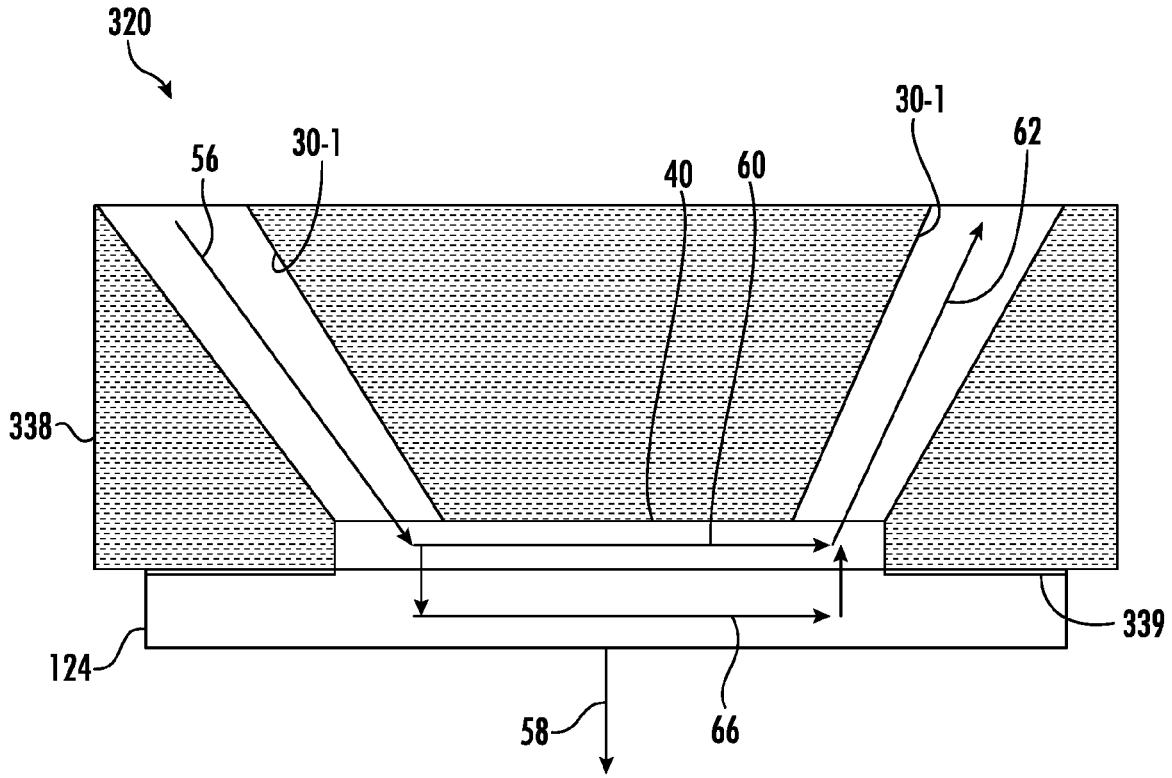
FIG. 4 is a sectional view schematically illustrating portions of an example fluid ejection assembly.

FIG. 4 is a sectional view schematically illustrating portions of an example fluid ejection assembly 320. Fluid ejection assembly 320 is similar to fluid ejection assembly 120 except that fluid ejection assembly 320 specifically comprises a single unitary polymeric body 338 in which both fan-out fluid passages 30 and recirculation channel 40 extend. Body 338 is joined or assembled to fluid ejection die 124 by an intermediate adhesive layer 339. Because both fan-out fluid passages 30 and recirculation channel 40 are formed in a single unitary polymeric body 338, assembly costs may be reduced as the single unitary polymeric body 338 automatically provides alignment between passages 30 and channel 40. Such automatic alignment which may facilitate the design and use of smaller, more compact fluid ejection assembly 320 at a lower cost.

Figure 5:
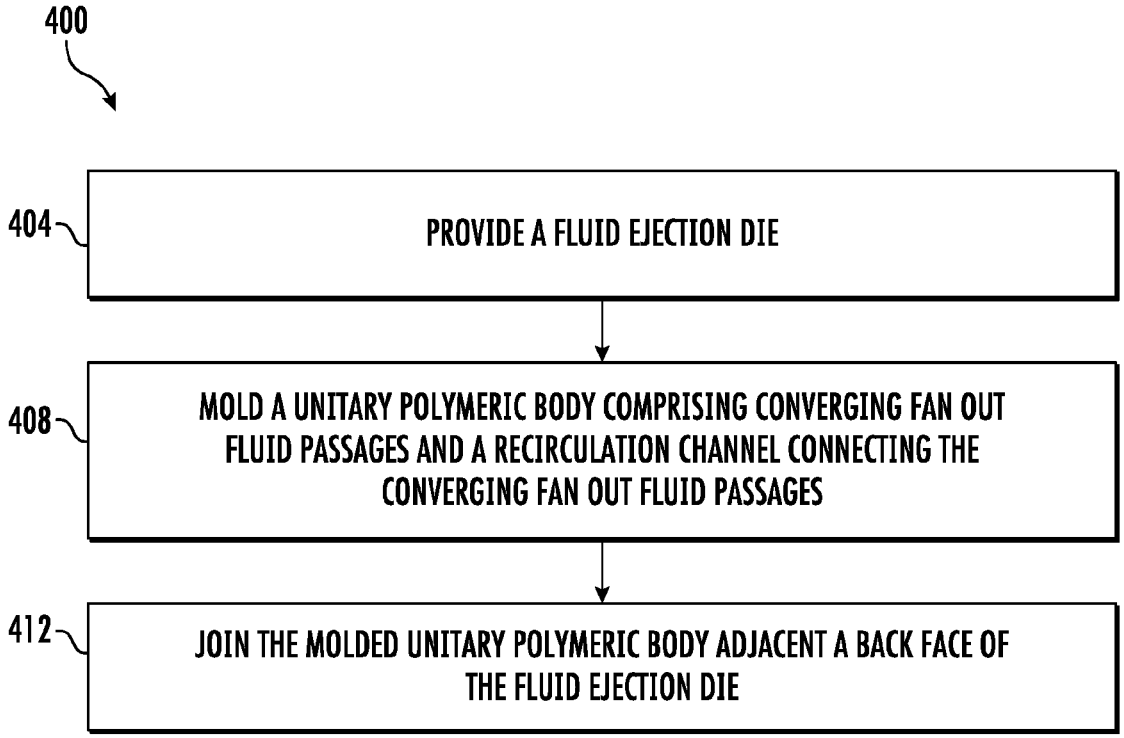
FIG. 5 is a flow diagram of an example method for forming an example fluid ejection assembly.

FIG. 5 is a flow diagram of an example method 400 for forming an example fluid ejection assembly, such as fluid ejection assembly 320. As indicated by block 404, a fluid ejection die, such as fluid ejection die 24 or die 124, is provided.

As indicated by block 408, a unitary polymeric body, such as body 338 is molded. The molded unitary polymeric body comprises converging fan-out fluid passages, such as fluid passages 30, and a recirculation channel, such as recirculation channel 40, that connect the converging fan-out fluid passages. As indicated by block 412, the molded unitary polymeric body is joined adjacent a back face of the fluid ejection die. Because method 400 molds the polymeric body and correspondingly molds the fan-out fluid passages and the recirculation channel, the location, shape and dimensions of the fan-out fluid passages and recirculation channel may be more precisely controlled and may be fabricated at a lower cost and complexity. In some implementations, the molding of the recirculation channel may facilitate a more dense arrangement of recirculation channels to provide enhanced fluid circulation and agitation. Because the fan-out fluid passages and the circulation channel are concurrently molded in a single unitary polymeric body, individual alignment of the fan-out fluid passages in the circulation channels is automatically achieved as part of the molding operation. Moreover, the use of adhesives may be reduced. As a result, method 400 may facilitate the provision of smaller and more compact ejection assemblies at a reduced cost.

Figure 6:
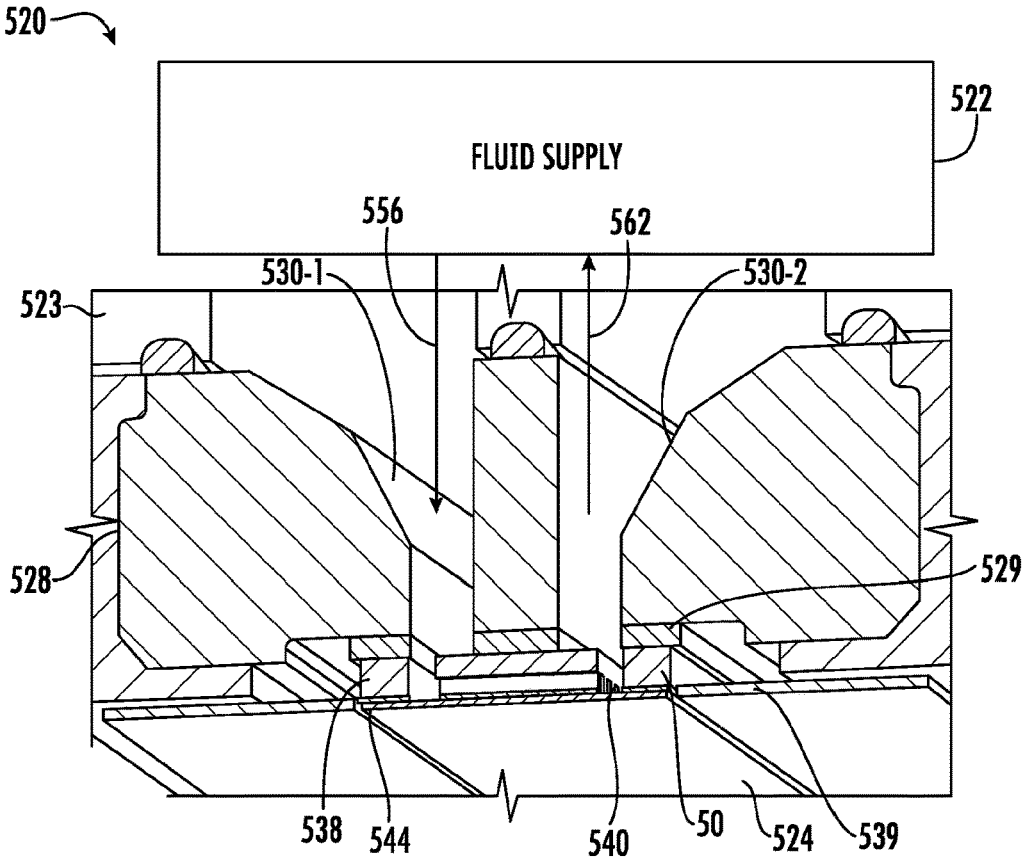
FIG. 6 is a sectional view illustrating portions of an example fluid ejection assembly.

FIG. 6 is a sectional view illustrating portions of an example fluid ejection assembly 520. Fluid ejection assembly 520 comprises fluid supply 522, fluid ejection die 524, fan-out body 528, and recirculation body 538. Fluid supply 522 (schematically illustrated) supplies the fluid for ejection by fluid ejection die 524. In one implementation, fluid supply 522 supplies such fluid under a controlled pressure to facilitate movement of fluid through assembly 520. Fluid ejection die 524 is similar to fluid ejection die 24 or die 124 described above.

Fan-out body 528, sometimes referred to as a fan-out chiclet, comprises a body extending between fluid supply 522 and recirculation body 538. In the example illustrated, fan-out body 528 is bonded to a larger fluid manifold 523 which directs fluid from fluid supply 522 to body 528. In one implementation, body 528 comprises a single unitary body. In one implementation, body 528 is formed from a single unitary polymeric body. For example, one implementation, body 528 may be formed from a polymer such as PPS, PE, PET, PEEK, PSU, LCP, and so on. Body 528 is joined to circulation body 538 by an intermediate adhesive 539.

Similar to body 228 described above, body 528 comprises fan-out fluid passages 530-1 and 530-2 (collectively referred to as passages 530). Passages 530 are similar to passages 30 described above. Passages 530 converge towards the back face 544 of fluid ejection die 524. Fan-out fluid passages 530 converge towards one another to direct fluid to the generally much smaller dimensioned fluid ejection die 524.

Recirculation body 538 is similar to body 238 described above. Recirculation body 538 is sandwiched between fan-out body 528 and fluid ejection die 524. Recirculation body 538 comprises a single unitary polymeric body. In one implementation, the circulation body 538 may be formed from an epoxy mold compound. In other implementations, recirculation body 53 may be formed from other polymers such as PPS, PE, PET, PEEK, PSU, LCP, and so on.

Body 538 is joined to fluid ejection die 524 by an intermediate adhesive layer 539. In other implementations, body 528 may be joined to body 538 and body 538 may be joined to fluid ejection die 524 in other ways, such as through the use of fasteners, fusing a welding, connectors and the like. In one implementation, bodies 528 and 538 are formed from the same polymeric material 50. In other implementations, bodies 528 and 538 are formed from different polymeric materials.

Body 538 comprises a series of recirculation channels 540 that are formed within and extend within the polymeric material forming body 538. Each of the recirculation channels 540 is similar to recirculation channels 40 described above. Each of the recirculation channels 540 facilitates the circulation of fluid across the back face of fluid ejection die 524, between fan-out fluid passages 530.

Because recirculation channels 540 are formed within polymeric material 50, each recirculation channel 540 may be provided with more closely controlled shape and dimensions at a lower cost. The more closely controlled dimensions may facilitate the formation of a larger number or greater density of smaller individually sized recirculation channels 540 which may provide greater circulation velocity for enhanced agitation or mixing. For example, recirculation channel 540 may be molded into the polymeric material 50.

The polymeric material in which recirculation channel 540 extends may define the interior side walls of each recirculation channel 540 and may contact or extend adjacent to fluid ejection die 524. As compared to other materials, such as silicon, the polymeric material may have enhanced chemical resistivity to the fluids being circulated. As a result, interior surfaces of each fluid ejection channel 540 have a greater resistance to corrosion caused by the fluid being circulated. Moreover, as compared to other materials such as silicon, the polymeric material may enhance thermal insulative properties, facilitating a more uniform temperature across fluid ejection die 524 and fluid ejection apparatus 520. The more uniform temperature may enhance fluid ejection performance.

As further shown by FIG. 6, fluid supply 522 supplies fluid in the direction indicated by arrow 556 which is circulated through fan-out passage 530-1, through recirculation body 538 and fluid ejection die 524 for ejection. A portion of the fluid flowing through fan-out passage 530-1 may flow through one of the recirculation channels 540 across the back face of fluid ejection die 524. The fluid may then return towards fluid supply 522, through fan-out passage 530-2 as indicated by arrow 562.

Figure 7:
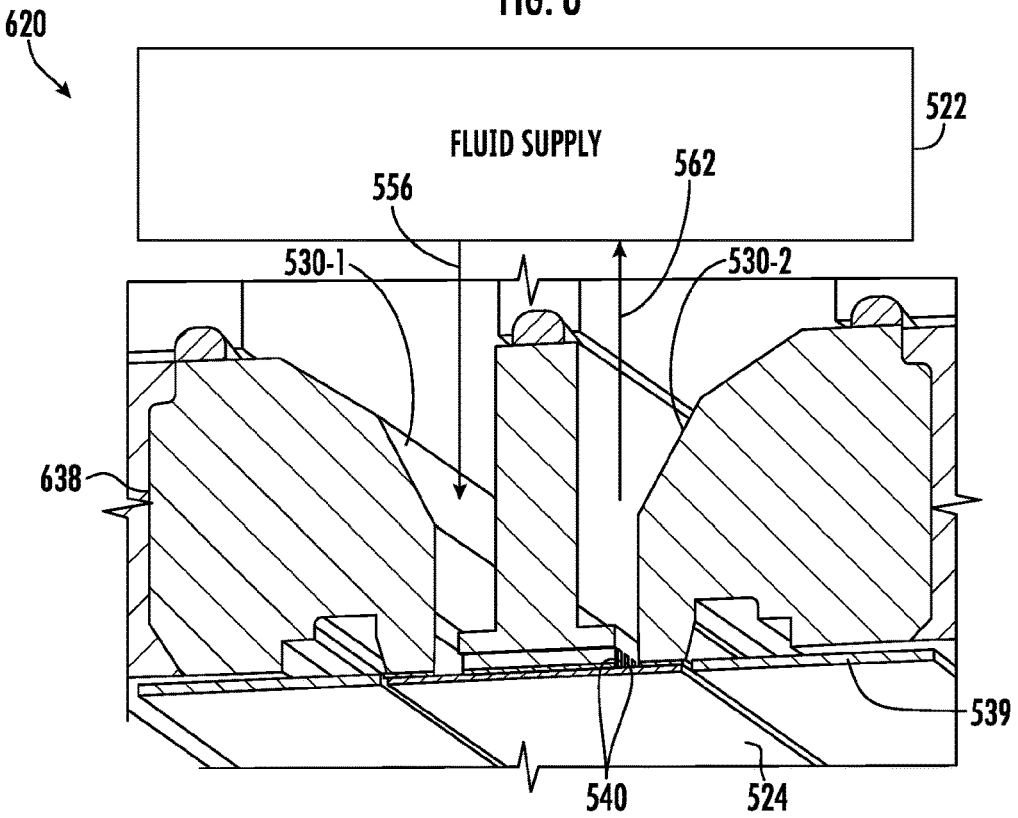
FIG. 7 is a sectional view illustrating portions of an example fluid ejection assembly.

FIG. 7 is a sectional view illustrating portions of an example fluid ejection assembly 620. Assembly 620 is similar to assembly 520 described above except that bodies 528 and 538 are replaced with a single unitary polymeric body 638. Body 638 is similar to body 338 described above. Body 638 comprises a single unitary polymeric body in which both fan-out fluid passages 530 and recirculation channel 540 extend. Body 638 is joined or assembled to fluid ejection die 524 by an intermediate adhesive layer 539. Because both fan-out fluid passages 530 and recirculation channel 540 are formed in a single unitary polymeric body 638, assembly costs may be reduced as the single unitary polymeric body 638 automatically provides alignment between passages 530 and channel 540. Such automatic alignment which may facilitate the design and use of smaller, more compact fluid ejection assembly 620 at a lower cost.

Figure 8A:
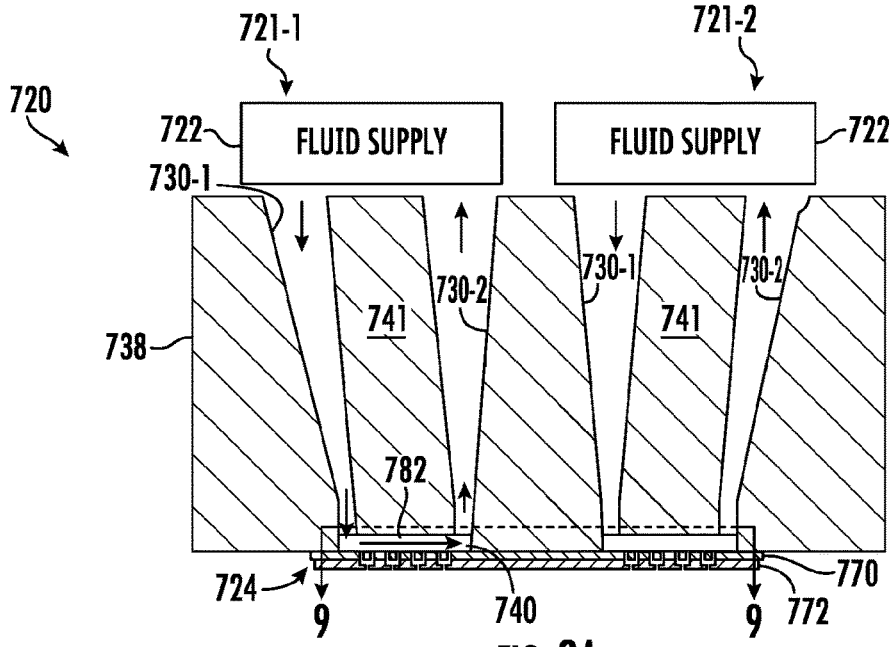
FIG. 8A is a sectional view illustrating portions of an example fluid ejection assembly.
Figure 8B:
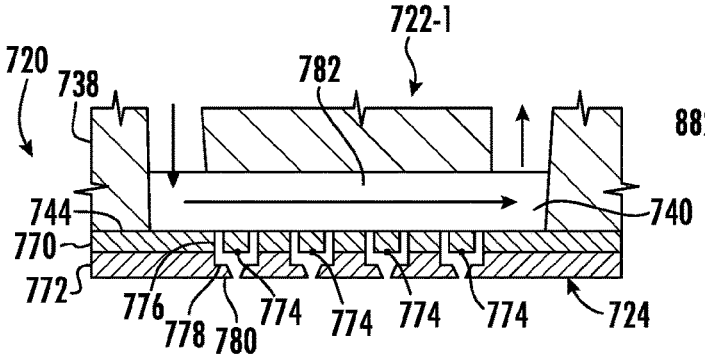
FIG. 8B is an enlarged sectional view illustrating portions of the fluid ejection assembly of FIG. 8A.

FIGS. 8A and 8B are sectional view illustrating portions of an example fluid ejection assembly 720. FIG. 8B is an enlarged view of a portion of FIG. 8A. Fluid ejection assembly 720 is similar to fluid ejection assembly 620 except that fluid ejection assembly 720 is specifically illustrated as comprising fluid ejection subsystems 721-1 and 721-2 (collectively referred to as subsystems 721). Subsystems 721 are illustrated as having distinct fluid supplies 722 but share an example unitary polymeric body 738 (sometimes referred to as a chiclet or molded chiclet) and a fluid ejection die 724. Other than the potentially different fluids that they may supply and eject, subsystems 721 are similar to one another. Thus, for sake of brevity, the description of subsystems 721-2 is omitted. It should be appreciated that the description of subsystems 721-1 equally applies to subsystems 721-2.

Fluid supply 722 supplies fluid to fluid ejection die 724 for being ejected. In some implementations, the fluid being supplied comprises an ink. In some implementations, the fluid being supplied comprises a pigment-based ink. In other implementations, fluid supply 722 may supply other types of fluid having particles that may settle. In one implementation, the fluid supply 722 of subsystems 721 supply and eject different types of fluid, such as different colors of ink. In other implementations, the fluid supplies 722 of subsystems 721 supply and eject the same fluids. In some implementations, subsystems 721 may share a single fluid supply 722.

As shown by FIG. 8A, subsystem 721-1 comprises a portion of fluid ejection die 724 and a portion of body 738. In other implementations, subsystems 721 may have separate dedicated fluid ejection dies 724. Fluid ejection die 724 is similar to fluid ejection die 124 and 524 described above except that fluid ejection die 724 is specifically illustrated as comprising substrate 770, chamber layer 772 and fluid actuators 774 (shown in FIG. 8B).

Substrate 770 comprises a layer or multiple layers of material, such as silicon, upon which chamber layer 772 and fluid actuators 774 are formed and supported. Substrate 770 comprises ink supply passages 776, in the form of fluid feed holes or slots, that direct fluid through substrate 770 into and out of fluid ejection chambers formed within chamber layer 772.

Chamber layer 772 comprises a layer or multiple layers of material, such as SU8, that form firing chambers 778 having fluid ejection orifices 780. In some implementations, chamber layer 772 may comprise multiple layers such as a first layer forming firing chambers 778 and a second layer, sometimes referred to as an orifice plate, forming orifices 780.

Fluid actuators 774 comprise electrically driven and controlled structures supported by substrate 770 adjacent to the firing chambers 778. Such fluid actuators 774 may be controlled by electrical control signals transmitted to electronic circuitry including transistors and the like, formed on substrate 770, to selectively actuate the fluid actuators 774. Each of such fluid actuators 774, upon being actuated, displaces fluid within the associated ejection chambers 778 so as to displace and eject fluid through the corresponding orifice 780.

In one implementation, each of fluid actuators 774 may comprise a thermal resistor which, upon receiving electrical current, heats to a temperature above the nucleation temperature of the solution so as to vaporize a portion of the adjacent solution or fluid to create a bubble which displaces fluid through the orifice. In other implementations, the fluid actuator may comprise other forms of fluid actuators. In other implementations, each of fluid actuators 774 may comprise a fluid actuator in the form of a piezo-membrane based actuator, an electrostatic membrane actuator, mechanical/impact driven membrane actuator, a magnetostrictive drive actuator, an electrochemical actuator, and external laser actuators (that form a bubble through boiling with a laser beam), other such microdevices, or any combination thereof. It should be appreciated that the described fluid ejection dies 24, 124 and 524 may be similar to fluid ejection die 724.

Body 738 comprises a single unitary polymeric body. In one implementation, body 738 may be formed from an epoxy mold compound. In other implementations, body 738 may be formed from other polymers such as PPS, PE, PET, PEEK, PSU, LCP, and the like. In one implementation, body 738 is molded so as to form fan-out fluid passages 730-1 and 730-2 (collectively referred to as passages 730) and recirculation channels 740. Fan-out fluid passages 730 are similar to fan-out fluid passages 530 described above. Fan-out fluid passages 730 converge towards one another as they approach the back face 744 of fluid ejection die 724.

Recirculation channels 740 are similar to recirculation channels 540 described above. In the example illustrated, recirculation channels 740 are separated by dividers 782. In one implementation, dividers 782 comprise a row or series of pillars extending between channels 740. Such pillars facilitate further crossflow and facilitate mixing. In another implementation, dividers 782 comprise a single elongate rib, a series of end-to-end ribs or staggered and overlapping ribs.

Figure 9:
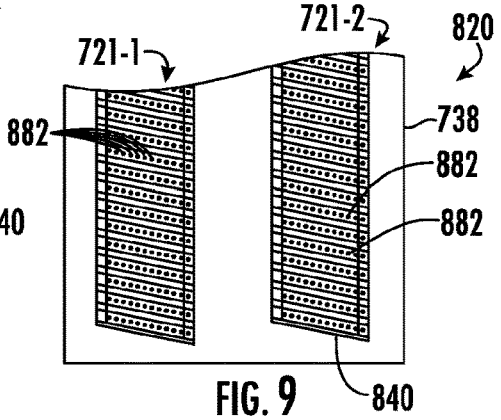
FIG. 9 is a sectional view illustrating portions of an example fluid ejection assembly take along line 9-9 of FIG. 8A.

FIG. 9 is a sectional view of portions of an example fluid ejection assembly 820 taken along line 9-9 of FIG. 8A. Fluid ejection assembly 820 is similar to fluid ejection assembly 720 except that fluid ejection assembly 820 is specifically illustrated as comprising recirculation channels 840 interconnecting the fan-out fluid passages 730 of the subsystems 721. In the example shown in FIG. 9, the fluid recirculation channels 840 diagonally extend between the respective pairs of fan-out fluid passages 730. In the example illustrated, consecutive fluid recirculation channels 840 are separated by a row or rows of intervening pillars 882. Pillars 882 allow fluid flow transversely between consecutive channels 840. Pillars 882 provide structural support for substrate 770 of fluid ejection die 724.

Figure 10A:
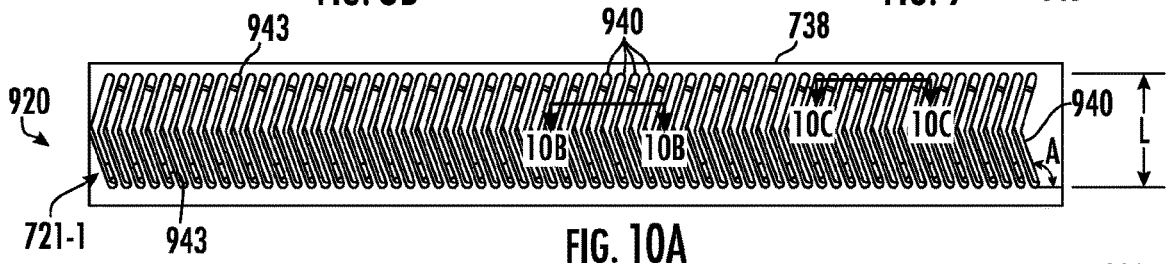
FIG. 10A is a bottom view of an example single unitary polymeric body and example recirculation channels formed therein.
Figure 10B:
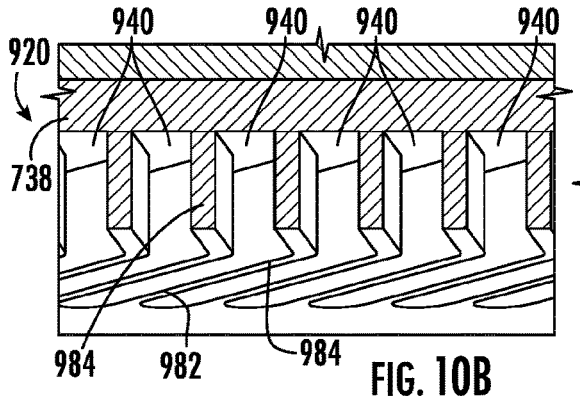
FIG. 10B is a sectional view of the single unitary polymeric body of 10*a* take along line 10B-10B.
Figure 10C:
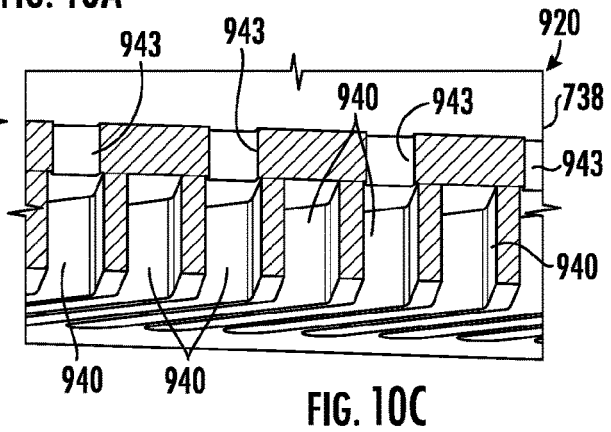
FIG. 10C is a sectional view of the single unitary polymeric body of 10*a* take along line 10C-10C.

FIGS. 10A, 10B and 10C illustrate portions of an example fluid ejection assembly 920. FIG. 10A is a bottom view illustrating portions of an example body 738 of fluid ejection assembly 920. FIGS. 10B and 10C are sectional views of the portions of the fluid ejection assembly 920 shown in FIG. 10A. Fluid ejection assembly 920 is similar to fluid ejection assembly 720 described above except that fluid ejection assembly 920 comprises the recirculation channels 940. Those remaining components of fluid ejection assembly 920 which correspond to portions of fluid ejection assembly 720 are numbered similarly or are shown in FIGS. 8A and 8B. It should be appreciated that the recirculation channels 940 shown for subsystems 721-1 in body 738 may likewise be provided for subsystem 721-2.

Similar to recirculation channels 740, recirculation channels 940 extend along a length of fluid fan-out passages 730-1 and 730-2, between such passages, and below portion 741 of body 738, as shown in FIG. 8A. Recirculation channels 940 each have a chevron-shape. Each of recirculation channels 940 has an inlet port 943 as shown in FIG. 10C, facilitating the inflow of fluid into the recirculation channel 940. As further shown by FIG. 10A, such input ports 943 alternate on opposite ends of channels 940 such that consecutive fluid input ports 943 on one side of channels 940 are separated by an intervening channel 940 omitting a fluid input port 943 on the same side of channels 940. In other words, input ports are provided in every even recirculation channel 940 on one side of the row of channels 940 and are provided in every odd recirculation channel 940 on the other side of the row of channels 940.

In the example illustrated, consecutive recirculation channels 940 are separated by dividers in the form of projecting ribs 982. Ribs 982 each have lower surfaces 984 for contacting or supporting fluid ejection die 724 (shown in FIGS. 8A and 8B). In one implementation each of the ribs 982 has a thickness of less than 150 μm. Each of the ribs 984, and the corresponding recirculation channel 940 has a height from 150 micrometres to greater than 150 micrometres. In one implementation, each of ribs 984 has a thickness or with of approximately 94 micrometres. In one implementation, each of the channels 940 has a width of less than or equal to 300 micrometres. In one implementation, channels 940 have a centerline to centerline pitch of no greater than 300 micrometres. In the example illustrated, the channels 940 have a length L from 2 mm to a length no greater than 4 mm. In the example illustrated, the legs of the individual chevrons have an angle A of approximately 72°.

Figure 11A:
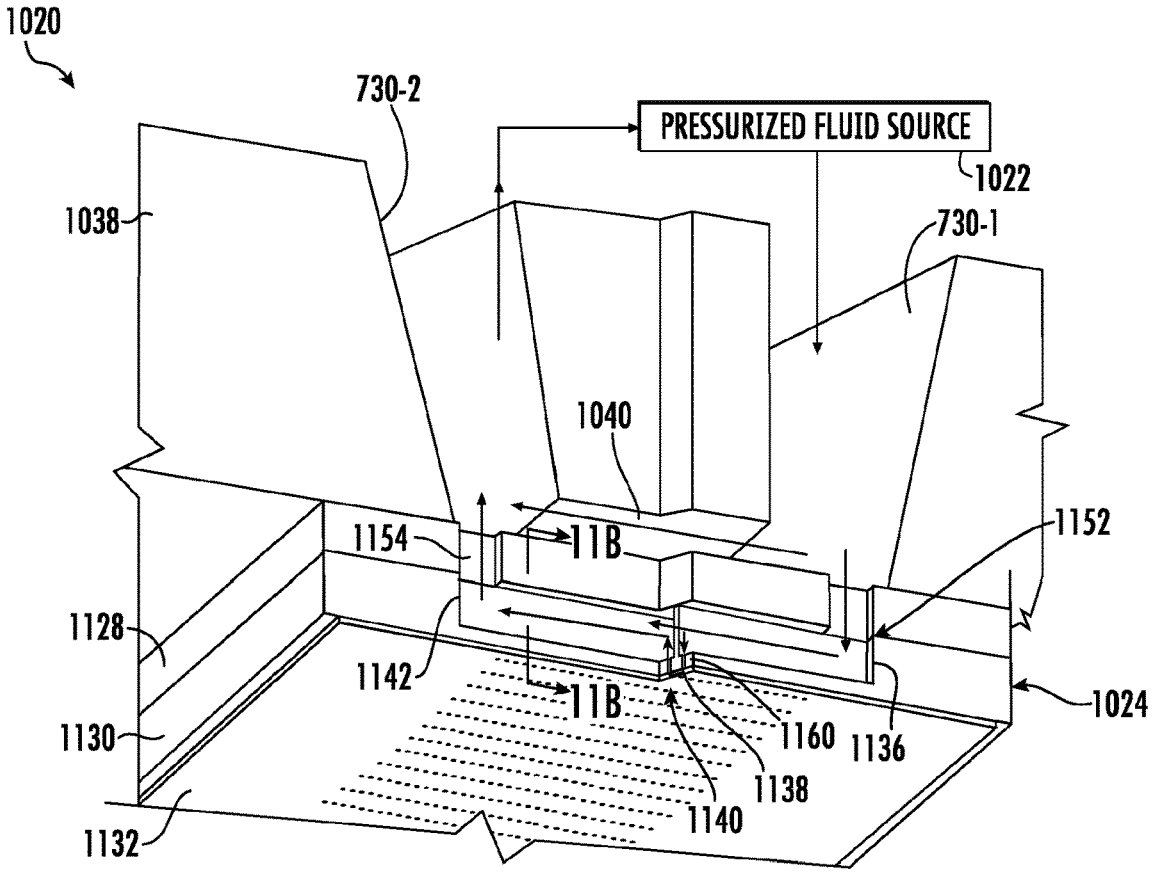
FIG. 11A is a sectional view illustrating portions of an example fluid ejection assembly.
Figure 11B:
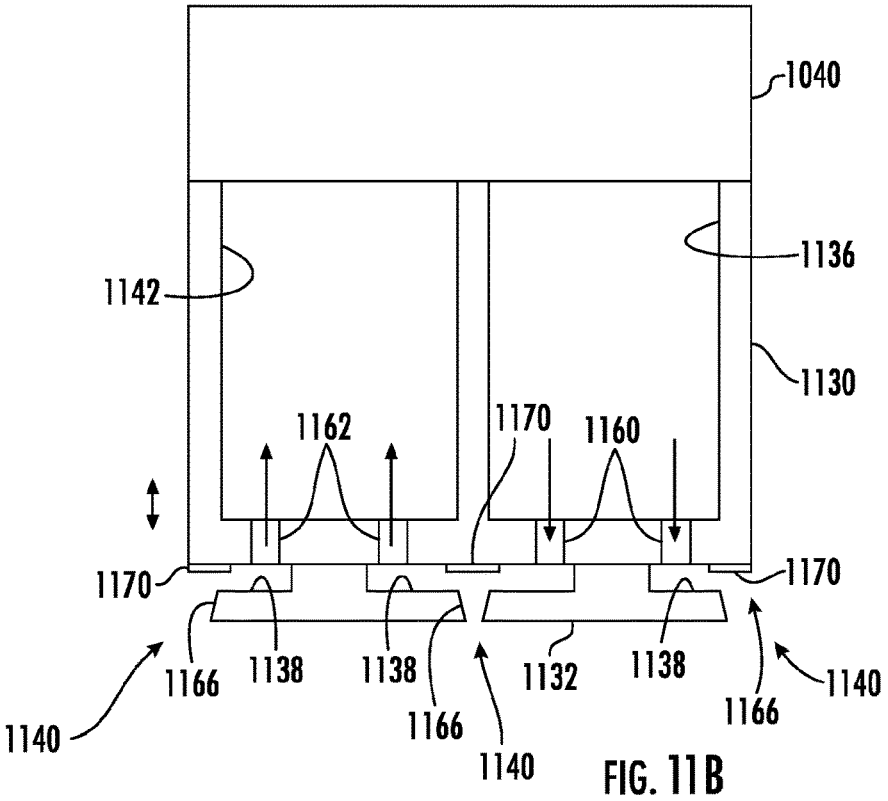
FIG. 11B is an enlarged sectional view of the example fluid ejection assembly of FIG. 11A take along line 11B-11B.

FIGS. 11A and 11B illustrate portions of an example fluid ejection assembly 1020. As with the above described assemblies, assembly 1020 reduces particle settling by using recirculation channels extending within a polymeric material. The recirculation channels are formed within a single unitary polymeric body 1038 that also provides fan-out fluid passages 730-1, 730-2. In one implementation, the single unitary polymeric body 1038 is formed from an epoxy mold compound. In other implementations, body 1038 may be formed from other polymers. In one implementation, body 1038 is molded to form fan-out fluid passages 730 and circulation channel 1040. In addition to body 1038, assembly 1020 comprises microfluidic die 1024. Microfluidic die 1024 provides a plurality of single orifice fluid ejectors 1140 which are supplied with a pressurized fluid from a pressurized fluid source 1022.

Microfluidic die 1024 comprises substrate 1128, chamber layer 1130 and orifice layer 1132. Substrate 1128 comprise a layer of material extending between body 1038 and chamber layer 1130. Substrate 1128 forms an inlet 1152 of fluid supply channel 1136 connected to fan-out fluid passage 730-1. Substrate 1128 further forms an outlet 1154 of fluid discharge channel 1142 connected to fan-out fluid passage 730-2. In one implementation, substrate 1128 is formed from silicon. In other implementations, substrate 1128 may be formed from other materials such as polymers, ceramics, glass and the like.

Chamber layer 1130 comprises a layer of material forming fluid supply channel 1136, fluid discharge channel 1142 and a ceiling or top of ejection chamber 1138 (when assembly 1020 is ejecting fluid in a downward direction). FIG. 11B is a sectional view through a portion of assembly 1020 illustrating chamber layer 1130 and orifice layer 1132 in more detail. As shown by FIG. 11B, chamber layer 1130 cooperates with substrate 1128 to form fluid supply channel 1136 and fluid discharge channel 1142. Chamber layer 1130 comprises openings 1160 that extend through layer 1130 opposite interposer substrate 1128. Each of openings 1160 is located so as to form an inlet or feed hole of a partially overlying ejection chamber 1138. Likewise, chamber layer 1130 comprises openings 1162 that extend through layer 1130 opposite substrate 1128. Each of openings 1162 is located to as to form an outlet or discharge hole of a partially overlying ejection chamber 1138.

As shown by FIGS. 11A and 11B, orifice layer 1132 comprises a layer of material deposited or formed upon chamber layer 1130 and patterned so as to form the sides and floor of each firing chamber 1138 and the single nozzle or orifice 1166 of each firing chamber 1138. Orifice layer 1132 cooperates with chamber layer 1130 to form each ejection chamber 1138. In one implementation, orifice layer 1132 may comprise a photoresist epoxy material such as SU8 (a Bisphenol A Novolac epoxy that is dissolved in an organic solvent gamma-butyrolactone GBL or cyclopentanone), facilitating patterning of layer 1132 to form the floor and sides of each ejection chamber 138 as well as the nozzle or orifice 1166 of each fluid ejector. In yet other implementations, orifice layer 1132 may be formed from other materials.

As shown by FIG. 11B, each ejector 1140 further comprises a fluid actuator 1170 within each ejection chamber 1138, generally opposite to orifice 1166. In the example illustrated, each fluid actuator 1170 comprises a thermal resistor electrically connected to a source of electrical power and associated switches or transistors by which electric current is selectively supplied to the resistor to generate sufficient heat so as to vaporize adjacent liquid in form and expanding bubble that displaces and expels non-vaporized fluid through orifice 1166. In other implementations, each fluid actuator 1170 may comprise other forms of fluid actuators such as a piezoelectric membrane based actuator, an electrostatic membrane actuator, a mechanical/impact driven membrane actuator, a magneto-strictive drive actuator, or other such elements that may cause displacement of fluid responsive to electrical actuation.

As indicated by the arrows shown in FIGS. 11A and 11B, pressurized fluid source 1022 supplies fluid through fan-out fluid passage 730-1. The fluid passes through inlet 1152 and travels along microfluidic supply channel, reaching the dead end of channel 1136, pressurizing channel 1136. The pressurized fluid within supply channel 136 flows into the inlet 1160 of each of fluid ejectors 1140. The fluid flows or circulated across each drive chamber 1138, which is in the form of a thin elongate microfluidic passage or channel. The fluid not ejected through orifice 1166 by the fluid actuator 1170 (shown in FIG. 11B) is discharged through outlet 1162 into fluid discharge channel 1142 and back to fan-out fluid passage 730-2.

As shown by FIG. 11A, recirculation channel 1040 extends between body 1038 and substrate 1128 which forms the floor of channel 1040. Recirculation channel 1040 provides a larger flow dimension by which fluid may be circulated across and behind each of the fluid ejectors 1140 to carry away excess heat. Large circulating flow rate of fluid may facilitate a more uniform and constant temperature across the different fluid ejectors 1140 for more reliable and consistent fluid ejection or printing performance. Such recirculation may further agitate the fluid to reduce settling of particles or pigments out of the fluid.

Although the present disclosure has been described with reference to example implementations, workers skilled in the art will recognize that changes may be made in form and detail without departing from the disclosed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluid ejection assembly comprising:

a fluid ejection die comprising a back face and a front face through which fluid is ejected;

fan-out fluid passages converging towards the back face of the fluid ejection die, the fan-out fluid passages comprising a first fan-out fluid passage and a second fan-out fluid passage; and a recirculation channel extending within a polymeric material from the first fan-out fluid passage to the second fan-out fluid passage adjacent the back face of the fluid ejection die.

2. The fluid ejection assembly of claim 1 further comprising a unitary polymeric body through which the fan-out fluid passages and the recirculation channel extend.

3. The fluid ejection assembly of claim 2, wherein the unitary polymeric body comprises an epoxy mold compound.

4. The fluid ejection assembly of claim 2, wherein the unitary polymeric body comprises a second recirculation channel extending from the first fan-out fluid passage to the second fan-out fluid passage adjacent the back face of the fluid ejection die.

5. The fluid ejection assembly of claim 4, wherein the recirculation channel and the second recirculation channel are each chevron shaped.

6. The fluid ejection assembly of claim 4, wherein the recirculation channel and the second recirculation channel are separated by a divider having a thickness of less than 150 micrometres.

7. The fluid ejection assembly of claim 4, wherein the recirculation channel has a height from 150 micrometres to above 150 micrometres.

8. The fluid ejection assembly of claim 6 wherein the unitary polymeric body comprises a third recirculation channel extending from the first fan-out fluid passage to the second fan-out fluid passage adjacent the back face of the fluid ejection die, wherein the recirculation channel and the second recirculation channel are separated by a first divider, wherein the second recirculation channel and the third recirculation channel are separated by a second divider and wherein the first divider and the second divider have a centerline to centerline pitch of no greater than 300 micrometres.

9. The fluid ejection assembly of claim 8, wherein the divider is selected from a group of dividers consisting a rib, a series of ribs; a pillar and a series of pillars.

10. The fluid ejection assembly of claim 2, wherein the fluid ejection die comprises:

a row of fluid ejectors, each of the fluid ejectors comprising a fluid actuator and an ejection chamber;

a first die circulation passage on a first side of the row of fluid ejectors and connected to the ejection chamber of each of the fluid ejectors, the first die circulation passage being connected to the first fan-out fluid passage; and a second die circulation passage on a second side of the row of fluid ejectors and connected to the ejection chamber of each of the fluid ejectors, the second die circulation passage being connected to the second fan-out fluid passage.

11. The fluid ejection assembly of claim 1 further comprising:

a first unitary polymeric body through which the fan-out fluid passages extend; and a second unitary polymeric body through which the recirculation channel extends, the second unitary polymeric body joined to the first unitary polymeric body.

12. A method comprising:

providing a fluid ejection die;

molding a unitary polymeric body comprising:

converging fan-out fluid passages; and a recirculation channel connecting the converging fan-out fluid passages; and joining the molded unitary polymeric body adjacent a back face of the fluid ejection die.

13. The method of claim 12, wherein the unitary polymeric body comprises a second recirculation connecting the converging fan-out fluid passages.

14. A fluid ejection assembly component for being joined to a fluid ejection die, the fluid ejection assembly component comprising:

a unitary polymeric body comprising:

fan-out fluid passages that converge, the fan-out fluid passages comprising a first fan-out fluid passage and a second fan-out fluid passage; and recirculation channels extending from the first fan-out fluid passage to the second fan-out fluid passage.

15. The fluid ejection assembly component of claim 14 wherein consecutive recirculation channels are separated by a divider selected from a group of dividers consisting of a rib, a series of ribs, a pillar, and a series of pillars, the divider having a thickness of less than 150 micrometres and a height from 150 micrometres to greater than 150 micrometres, wherein the dividers have a centerline to centerline pitch of no greater than 300 micrometres.

* * * * *